US011295695B2

(12) United States Patent
Zhang

(10) Patent No.: US 11,295,695 B2
(45) Date of Patent: Apr. 5, 2022

(54) TERMINAL SCREEN, CONTROL METHOD THEREOF AND TERMINAL

(71) Applicant: BEIJING XIAOMI MOBILE SOFTWARE CO., LTD., Beijing (CN)

(72) Inventor: Lintao Zhang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/543,193

(22) Filed: Aug. 16, 2019

(65) Prior Publication Data

US 2020/0098332 A1 Mar. 26, 2020

(30) Foreign Application Priority Data

Sep. 21, 2018 (CN) ..... 201811109908.0
Nov. 16, 2018 (CN) ..... 201811368004.X

(51) Int. Cl.
*G09G 5/00* (2006.01)
*G09G 5/02* (2006.01)

(52) U.S. Cl.
CPC ..... *G09G 5/003* (2013.01); *G09G 5/02* (2013.01); *G09G 2354/00* (2013.01)

(58) Field of Classification Search
CPC combination set(s) only.
See application file for complete search history.

(56) References Cited

U.S. PATENT DOCUMENTS 9,626,937 B2 4/2017 Liu et al.
10,210,832 B2 2/2019 Ma et al.
2011/0153284 A1 6/2011 Li et al.
2014/0354596 A1 12/2014 Djordjev et al.
2017/0237152 A1* 8/2017 Lee ..... H01Q 5/371 343/702
2018/0026080 A1* 1/2018 Lee ..... H01L 27/3211 257/40
2018/0089491 A1 3/2018 Kim et al.
2018/0174520 A1* 6/2018 Park ..... G09G 3/3258
2018/0196931 A1 7/2018 Cho et al.
2018/0211619 A1 7/2018 Ma et al.
(Continued)

FOREIGN PATENT DOCUMENTS

CN 103903548 A 7/2014
CN 105094307 A 11/2015
(Continued)

OTHER PUBLICATIONS

Korean Notification of Reason for Refusal of Korean Application No. 10-2019-7028716 dated Apr. 29, 2020 with English translation, (18p).

(Continued)

*Primary Examiner* — Kee M Tung
*Assistant Examiner* — Khoa Vu
(74) *Attorney, Agent, or Firm* — Arch & Lake LLP

(57) ABSTRACT

Provided are a terminal screen, a control method thereof, and a terminal. The terminal screen includes: a substrate and a display layer arranged on the substrate. The display layer includes a main display area and n auxiliary display areas, and n is a positive integer. The main display area and an i-th auxiliary display area in the n auxiliary display areas have different attributes, and i is a positive integer that is less than or equal to n.

17 Claims, 7 Drawing Sheets

(56) References Cited

U.S. PATENT DOCUMENTS

| | | | | |
|---|---|---|---|---|
| 2018/0261661 | A1 | 9/2018 | Jin | |
| 2019/0130822 | A1* | 5/2019 | Jung | H01L 27/32 |
| 2019/0172399 | A1* | 6/2019 | Chen | G09G 3/3688 |
| 2019/0295503 | A1* | 9/2019 | Ouderkirk | G09G 5/04 |
| 2019/0361543 | A1* | 11/2019 | Zhang | G06F 1/1684 |
| 2021/0191552 | A1* | 6/2021 | Bok | G06F 3/0443 |

FOREIGN PATENT DOCUMENTS

| | | | |
|---|---|---|---|
| CN | 106652929 | A | 5/2017 |
| CN | 106774689 | A | 5/2017 |
| CN | 106850897 | A | 6/2017 |
| CN | 107077256 | A | 8/2017 |
| CN | 107808606 | A | 3/2018 |
| CN | 108091298 | A | 5/2018 |
| CN | 108257514 | A | 7/2018 |
| CN | 108364967 | A | 8/2018 |
| CN | 108389879 | A | 8/2018 |
| JP | 2016530902 | A | 10/2016 |
| KR | 20100040988 | A | 4/2010 |
| KR | 101257939 | B1 | 4/2013 |
| KR | 20130139485 | A | 12/2013 |
| RU | 2654135 | C2 | 5/2018 |
| WO | 2017164680 | A1 | 9/2017 |
| WO | 2018035045 | A1 | 2/2018 |

OTHER PUBLICATIONS

Russian Office Action and Search Report of Russian Application No. 2019130763 dated Jun. 2, 2020 with English translation, (14p).

Extended European Search Report of counterpart EP Application No. 19198568.8 dated Feb. 14, 2020, (15p).

International Search Report of PCT Application No. PCT/CN2019/088201 dated Aug. 21, 2019, (16p).

Notice of Allowance of counterpart Korean Application No. 10-2019-7028716 dated Nov. 26, 2020 with English translation, (6p).

Notice of Rejection of counterpart Japanese Application No. 2019-558670 dated Jan. 5, 2021 with English translation, (20p).

First Office Action issued to Chinese Application No. 201811368004.X dated Aug. 19, 2020 with English translation (29p).

Acceptance Decision of Russian Application No. 2019130763 dated Sep. 11, 2020, (13p).

* cited by examiner

TERMINAL SCREEN, CONTROL METHOD THEREOF AND TERMINAL

This application is based upon and claims priority to Chinese Patent Application 201811109908.0, filed on Sep. 21, 2018 and Chinese Patent Application 201811368004.X, filed on Nov. 16, 2018, the entire contents of which are incorporated herein by reference.

TECHNICAL FIELD

Embodiments of the present disclosure relate to the technical field of display screen, and more particularly, to a terminal screen, a control method thereof and a terminal.

BACKGROUND

The mobile phone industry has a higher and higher pursuit for screen-to-body ratios, expecting to produce mobile phones with the screen-to-body ratio approaching 100%.

The difficulty in increasing the screen-to-body ratio of a mobile phone lies in how to reasonably dispose the functional devices (e.g., a camera, an earphone, a light sensor, a distance sensor and a fingerprint sensor, etc.) on a front panel of the mobile phone to maximize the screen-to-body ratio. Currently, most solutions adopted by the industry are to design the screen of the mobile phone into a special-shaped screen structure. For example, a notch is formed in the top of the screen of the mobile phone. Then, the above-mentioned functional devices are disposed on the front panel at the notch.

Although the screen-to-body ratio of the special-shaped screen is increased to some extent, there still exists a significant problem that due to the notch, the display content in the screen is partially absent accordingly, leading to poor integrity.

SUMMARY

The embodiments of the present disclosure provide a terminal screen, a control method thereof and a terminal. The technical solutions are as follow.

According to a first aspect of the present disclosure, there is provided a terminal screen, comprising: a substrate and a display layer on the substrate. The display layer comprises a main display area and n auxiliary display areas, and n is a positive integer. The main display area and an i-th auxiliary display area in the n auxiliary display areas have different manufacturing attributes, and i is a positive integer that is less than or equal to n.

According to a second aspect of the present disclosure, there is provided a terminal comprising the terminal screen in the first aspect or provided by any optional design in the first aspect.

According to a third aspect of the present disclosure, there is provided a terminal, comprising a terminal screen. The terminal screen comprises a substrate and a display layer on the substrate. The display layer comprises a main display area and an auxiliary display area, light transmittance performance of the auxiliary display area is superior to that of the main display area. A functional device is disposed below the auxiliary display area.

According to a fourth aspect of the present disclosure, there is provided a control method of a terminal screen, configured to control the terminal screen in the first aspect or provided by any optional design in the first aspect. The method comprises: sending a first synchronizing signal to the main display area and a second synchronizing signal to the auxiliary display area, the first synchronizing signal and the second synchronizing signal being configured to control the main display area and the auxiliary display area to simultaneously display the same content.

According to a fifth aspect of the present disclosure, there is provided a terminal comprising the terminal screen in the first aspect or provided by any optional design in the first aspect. The terminal further comprises: a processor; and a memory for storing instructions executable by the processor. The processor is configured to: send a first synchronizing signal to the main display area and a second synchronizing signal to the auxiliary display area, the first synchronizing signal and the second synchronizing signal being configured to control the main display area and the auxiliary display area to simultaneously display the same content.

It is to be understood that both the foregoing general description and the following detailed description are merely exemplary and explanatory, and do not limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of devices and methods consistent with aspects related to the invention as recited in the appended claims.

Figure 1:
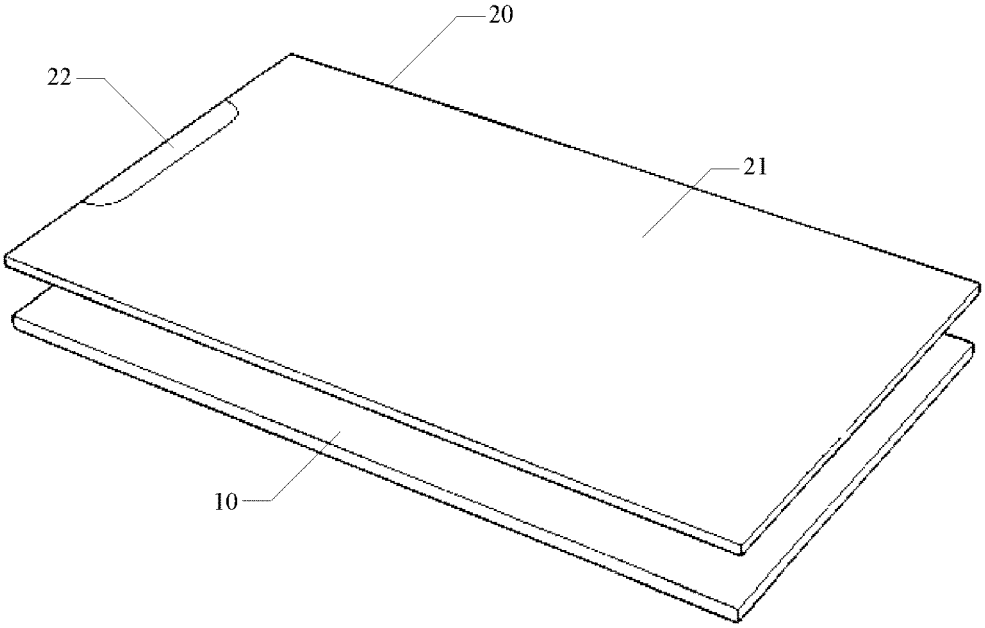
FIG. 1 is a schematic view of a terminal screen in accordance with an aspect of the disclosure.

FIG. 1 is a schematic view of a terminal screen in accordance with an aspect of the disclosure. As shown in FIG. 1, the terminal screen may comprise a substrate 10 and a display layer 20 arranged on the substrate 10.

The display layer 20 is configured to realize a display function of the terminal screen. In the embodiment of the present disclosure, the display layer 20 comprises a main display area 21 and n auxiliary display areas 22, wherein n is a positive integer. Both of the main display area 21 and the auxiliary display area 22 have a display function. There may be one or a plurality of auxiliary display areas 22. In FIG. 1, there is one auxiliary display area 22 for schematic illustration.

In the embodiment of the present disclosure, the display layer 20 comprises the main display area 21 and the auxiliary display area 22, which are two different display areas but are an integral whole in physical structure. That is, the display layer 20 is of an integral structure and is not divided into a plurality of independent constituent portions.

If the display area 20 comprises a plurality of independent constituent portions, which are spliced to form the display layer 20, there inevitably exit certain clearances in splicing positions, which finally results in clearances between the display content of the constituent portions. Consequently, the display content of the whole display layer 20 may not be an integral whole or clearance-free.

However, in the embodiment of the present disclosure, since the main display area 21 and the auxiliary display area 22 are an integral whole in physical structure and have no clearances therebetween, there will be no clearances between the display content of the main display area 21 and the display content of the auxiliary display area 22. Thus, the display content of the whole display layer 20 is an integral whole and clearance-free.

In addition, in the embodiment of the present disclosure, the content displayed in the main display area 21 or the auxiliary display area 22 is not limited. For example, the main display area 21 and the auxiliary display area 22 may display different portions of the same user interface, and the display content of the two are an integral whole and clearance-free, bringing a better full-screen experience for a user.

In the embodiment of the present disclosure, the main display area 21 and an i-th auxiliary display area in the n auxiliary display areas 22 have different manufacturing attributes, wherein i is a positive integer that is less than or equal to n.

When the display layer 20 comprises one auxiliary display area 22, the main display area 21 and the auxiliary display area 22 have different manufacturing attributes.

When the display layer 20 comprises a plurality of auxiliary display areas 22, the main display area 21 may have different manufacturing attributes from any one of the auxiliary display areas 22 and may also have different manufacturing attributes from a plurality of auxiliary display areas 22. For example, the main display area 21 may have different manufacturing attributes from each auxiliary display area 22. In addition, the plurality of auxiliary display areas 22 may have the same or different manufacturing attributes.

In the embodiment of the present disclosure, the manufacturing attribute may include physical attribute formed during manufacturing. Optionally, the manufacturing attribute may include but not limited to at least one of resolution, light transmittance performance, pixel features and manufacturing processes.

For example, the manufacturing attribute may include resolution. Optionally, the resolution of the main display area 21 is higher than that of the i-th auxiliary display area. The "resolution" involved in the embodiment of the present disclosure may also be called display resolution or screen resolution, which is an index for representing the number of pixels that may be displayed by a screen. For example, the resolution of the main display area 21 is 400 ppi (pixels per inch), and the resolution of the i-th auxiliary display area is only 100 ppi or even lower. Under an extreme condition, the i-th auxiliary display area may only have one pixel. That is, each frame of the i-th auxiliary display area may only display a color block formed by a single color or RGB mixing.

In another example, the manufacturing attribute may include light transmittance performance. The light transmittance performance of the main display area 21 is different from that of the i-th auxiliary display area. For example, after the same light passes through the main display area 21 and the i-th auxiliary display area, emergent light is different in wavelength, amplitude or phase position. Optionally, when the light transmittance performance represents the medium-passing capability of light, the light transmittance performance of the main display area 21 is poorer than that of the i-th auxiliary display area. The light transmittance performance may be represented by light transmittance which is the percentage of flux of light passing through a medium (e.g., the main display area 21 and the auxiliary display area 22 in the embodiment of the present disclosure) to incident light flux. The light transmittance may also be called transmittance. Optionally, the i-th auxiliary display area has the light transmittance greater than 30%. Alternatively, the i-th auxiliary display area has the light transmittance greater than 40%. Alternatively, the i-th auxiliary display area has the light transmittance greater than 50%. Under a possible condition, the i-th auxiliary display area is completely transparent, that is, the light transmittance of the i-th auxiliary display area is 100%.

In another example, the manufacturing attribute comprises pixel features. The pixel features may include physical features of a pixel formed in the display layer 20 and comprises but not limited to at least one of pixel size, pixel distribution density and pixel distribution pattern.

Figure 2A:
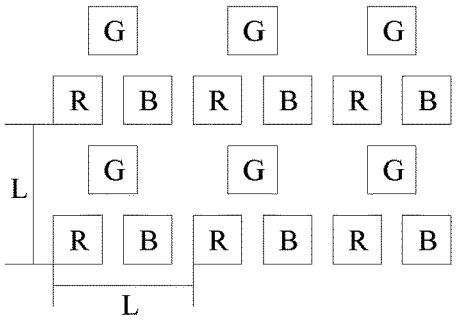
FIG. 2A shows a schematic view of a pixel distribution pattern of a main display area.
Figure 2B:
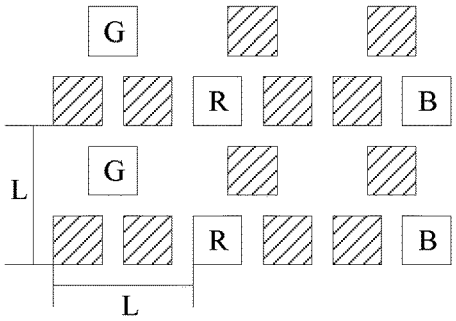
FIG. 2B shows a schematic view of a pixel distribution pattern of an auxiliary display area.

In a possible implementation, the main display area 21 and the i-th auxiliary display area have the same pixel distribution pattern, and at least one dummy pixel exists in the i-th auxiliary display area. For example, FIG. 2A illustrates a pixel distribution pattern of the main display area 21. FIG. 2B illustrates a pixel distribution pattern of the i-th auxiliary display area. It can be seen from FIG. 2A and FIG. 2B that the pixel distribution patterns of the two are the same, and some dummy pixels (e.g., pixels with shadows in FIG. 2B) exist in the i-th auxiliary display area. In one case, the dummy pixel may be a luminous pixel with luminous power weaker than that of a normal pixel.

In another case, the dummy pixel may be a non-luminous pixel. Exemplarily, an implementation mode of the dummy pixel comprises but not limited to at least one of the followings: the dummy pixel is free from an access circuit, the dummy pixel is free from a driver TFT (Thin Film Transistor), and the dummy pixel is free from or is short of a material or a manufacturing layer for light emitting. For example, for an OLED (Organic Light-Emitting Diode) screen, a pixel definition layer (PLD) may be sealed in a certain pixel area, such that the pixel area is implemented as a non-luminous dummy pixel. When the main display area 21 and the auxiliary display area 22 have the same pixel distribution pattern, process production of the display layer 20 becomes easier.

Figure 3A:
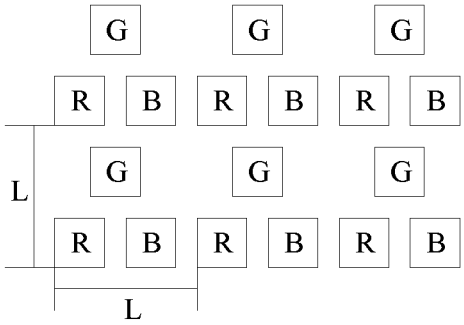
FIG. 3A shows a schematic view of another pixel distribution pattern of a main display area.
Figure 3B:
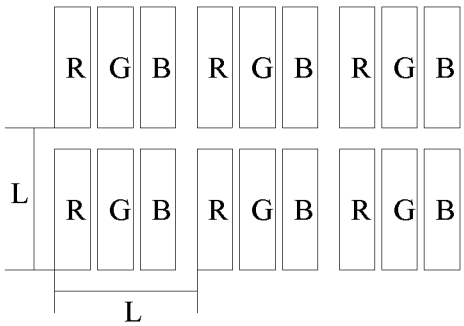
FIG. 3B shows a schematic view of another pixel distribution pattern of an auxiliary display area.

In another possible implementation, the main display area 21 and the i-th auxiliary display area have different pixel distribution patterns. For example, FIG. 3A illustrates a pixel distribution pattern of the main display area 21. FIG. 3B illustrates a pixel distribution pattern of the i-th auxiliary display area. It can be seen from FIG. 3A and FIG. 3B that the pixel distribution patterns of the two are different. When the main display area 21 and the auxiliary display area 22 have different pixel distribution patterns, process production of the display layer 20 becomes more complicated. However, if the main display area 21 and the auxiliary display area 22 have different pixel distribution patterns but the same pixel size and pixel distribution density, the main display area 21 and the auxiliary display area 22 are closer in light transmittance and display brightness. Thus, the display effect is enhanced.

In another example, the manufacturing attribute comprises manufacturing processes. The manufacturing processes mean process steps adopted for manufacturing the display layer 20. Optionally, the manufacturing process of the i-th auxiliary display area is that a certain/some process steps is/are added, reduced or modified on the basis of the manufacturing process of the main display area 21. In an example, to make the light transmittance of the i-th auxiliary display area be greater than that of the main display area 21, some process steps may be added. A material that adversely affects the light transmittance in the i-th auxiliary display area is removed. Some transparent materials are appropriately added. Thus, the i-th auxiliary display area and the main display area 21 are the same in thickness but different in light transmittance.

In addition, the main display area 21 has a color display function. Any one (e.g., the i-th auxiliary display area) of the auxiliary display areas 22 may have a monochrome display function and may also have a color display function. When the auxiliary display area 22 has the monochrome display function, the whole auxiliary display area 22 may only present one color at the same time and may present different colors at different time. When the auxiliary display area 22 has the color display function, the whole auxiliary display area 22 may present various different colors at the same time. For example, part of pixels are red and the other part of the pixels are brown.

Optionally, functional devices are disposed below the auxiliary display area 22. The functional devices comprise but not limited to at least one of following hardware units: a camera, an earphone, a light sensor, a distance sensor, a biosensor, an environmental sensor, a food safety detection sensor, a health sensor and an optical transmitter. Here, the camera is configured to play a picture shooting role, e.g., a common camera, an infrared camera, a depth camera, etc. The earphone is configured to achieve a sound playing function. The light sensor is configured to acquire the intensity of ambient light. The distance sensor is configured to acquire the distance of an object in front. The biosensor is configured to identify a biological feature of the user, e.g., a fingerprint recognition sensor, an iris recognition sensor, etc. The environmental sensor is configured to acquire environmental information, e.g., a temperature sensor, a humidity sensor, a gas pressure sensor, etc. The food safety detection sensor is configured to detect indexes of some harmful substances in food, e.g., an optical sensor, a biometric sensor, etc. The health sensor is configured to acquire health information of the user, e.g., a sensor for acquiring heart rate, blood pressure, heartbeat or other human body data of the user. The optical transmitter is a functional device for transmitting light, e.g., an infrared transmitter or some transmitters for transmitting other light.

One or a plurality of functional devices may be disposed below the auxiliary display area 22. For example, a camera and a distance sensor are disposed below a certain auxiliary display area 22. In addition, when the display layer 20 comprises a plurality of auxiliary display areas 22, the above-mentioned function devices may or may not be disposed below some auxiliary display areas 22, and the same or different functional devices may be disposed below two different auxiliary display areas 22. For example, the camera and the distance sensor are disposed below one auxiliary display area 22, and a fingerprint recognition sensor is disposed below another auxiliary display area 22.

Figure 4:
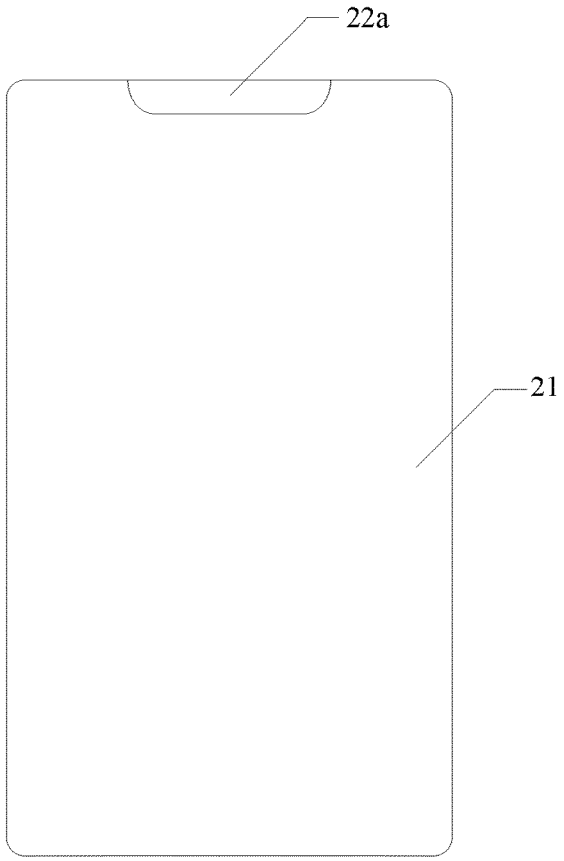
FIG. 4 shows an example schematic view of a first position relationship of a main display area and an auxiliary display area.
Figure 5:
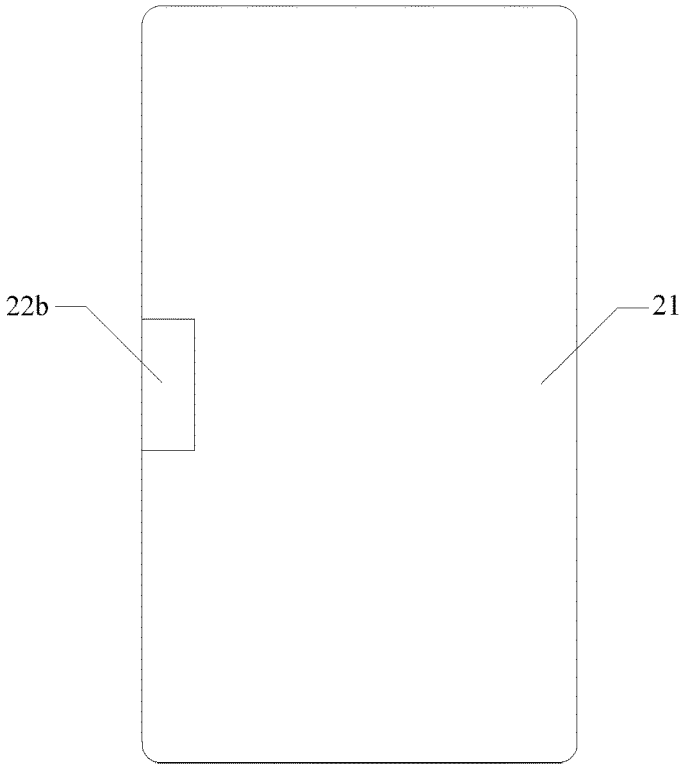
FIG. 5 shows an example schematic view of a first position relationship of a main display area and an auxiliary display area.
Figure 6:
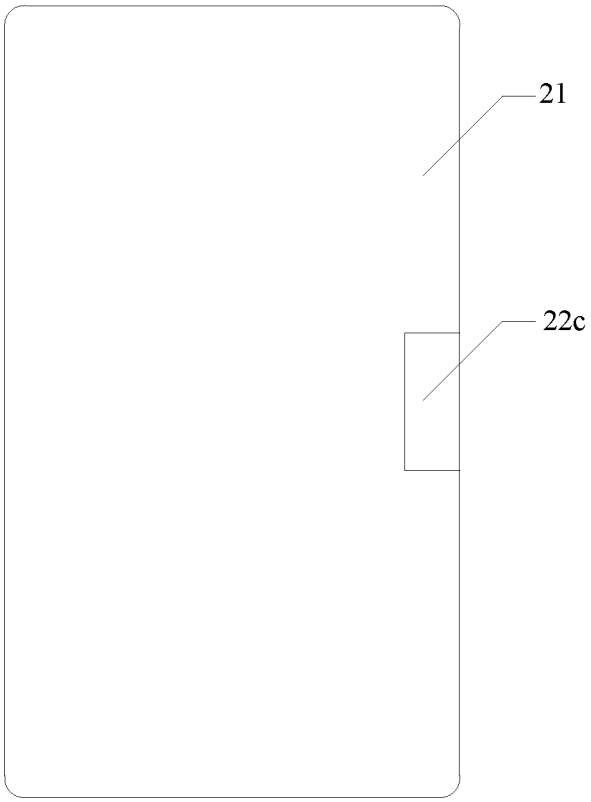
FIG. 6 shows an example schematic view of a second position relationship of a main display area and an auxiliary display area.
Figure 7:
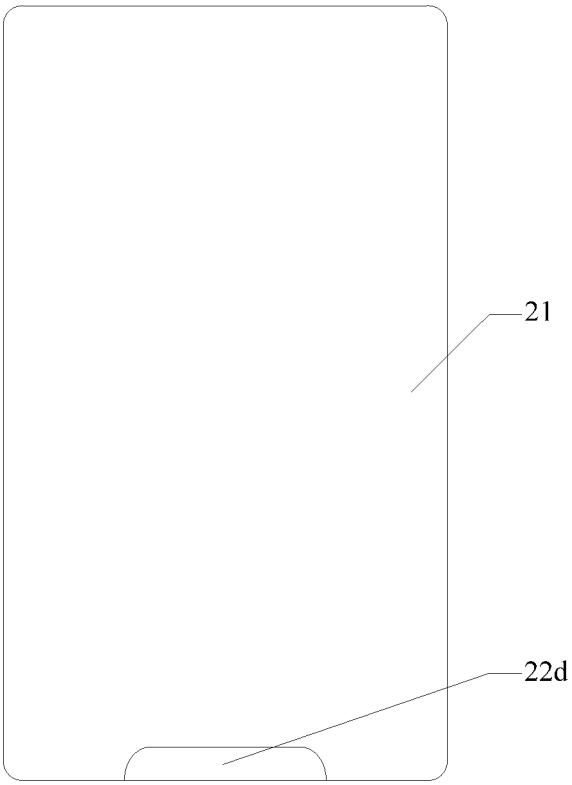
FIG. 7 shows an example schematic view of a third position relationship of a main display area and an auxiliary display area.
Figure 8:
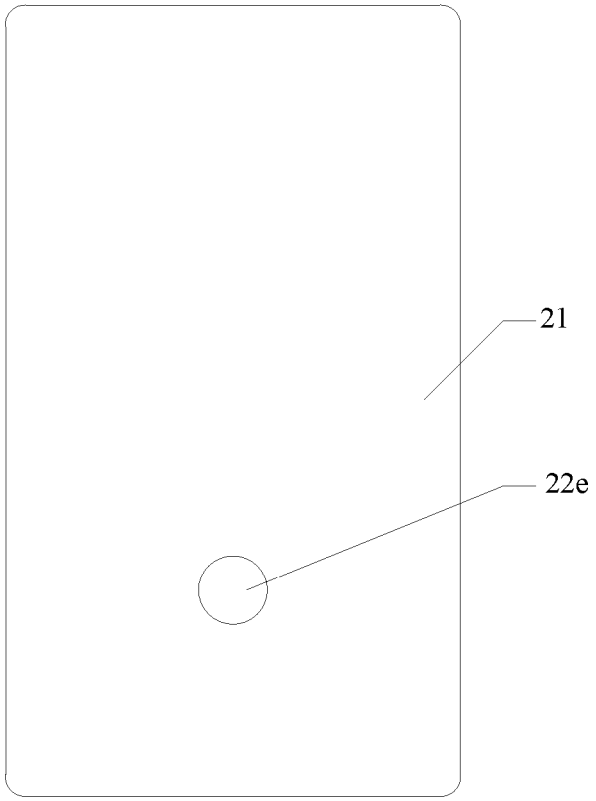
FIG. 8 shows an example schematic view of a fourth position relationship of a main display area and an auxiliary display area.

Optionally, the n auxiliary display areas 22 include at least one of the followings:

1. a first auxiliary display area 22*a* arranged in a notch portion formed in an edge at the top of the main display area 21, as shown in FIG. 4;
2. a second auxiliary display area 22*b* arranged in a notch portion formed in an edge on the left side of the main display area 21, as shown in FIG. 5;
3. a third auxiliary display area 22*c* arranged in a notch portion formed in an edge on the right side of the main display area 21, as shown in FIG. 6;
4. a fourth auxiliary display area 22*d* arranged in a notch portion formed in an edge at the bottom of the main display area 21, as shown in FIG. 7; and
5. a fifth auxiliary display area 22*e* arranged in a notch portion formed in the middle of the main display area 21, as shown in FIG. 8.

It should be noted that the types of the auxiliary display areas 22 in the display area 20 may be designed in accordance with actual needs. For example, the display layer 20 may only comprise the first auxiliary display area. Such functional devices as a camera and a distance sensor are disposed below the first auxiliary display area. For another example, the display layer 20 may comprise the first auxiliary display area, the second auxiliary display area and the third auxiliary display area. Wherein the camera and the distance sensor are disposed below the first auxiliary display area. The light sensor is disposed below the second auxiliary display area. The environmental sensor is disposed below the third auxiliary display area. For another example, the display area 20 may comprise the first auxiliary display area and the fourth auxiliary display area. The camera and the distance sensor are disposed below the first auxiliary display area. The fingerprint recognition sensor is disposed below the fourth auxiliary display area. For another example, the display layer 20 may comprise the first auxiliary display area and the fifth auxiliary display area. The camera and the distance sensor are disposed below the first auxiliary display area. The fingerprint recognition sensor is disposed below the fifth auxiliary display area. The above description is merely exemplary and explanatory, and is not intended to limit the technical solutions of the present disclosure.

Considering that there usually exists a limited space below an edge portion of the terminal screen, if the auxiliary display area 22 is located at a notch portion formed in an edge of the main display area 21, some functional devices in relatively smaller sizes are more suitable for being disposed below the auxiliary display area 22. If the auxiliary display area 22 is located at a notch portion formed in the middle of the main display area 21, some functional devices in relatively greater sizes are more suitable for being disposed below the auxiliary display area 22. In practice, the position of the auxiliary display area 22 may be reasonably designed in accordance with the functional devices required to be disposed in the terminal, such that enough space may be provided for the functional devices and a use habit of the user is met better.

It should be noted that in the embodiment of the present disclosure, the cross-section shape of the auxiliary display area 22 is not limited, which may be regular shapes such as a rectangle, a rounded rectangle, a circle, etc., and may also be irregular shapes such as a water drop, an arc, etc.

In addition, as shown in FIGS. 4-8, the embodiments merely take that a notch portion is formed in an edge or in the middle of the main display area 21 and the auxiliary display area 22 is arranged at the notch portion as an example for explanation. In some other possible embodiments, the main display area 21 may be free from a notch portion. The auxiliary display area 22 may be arranged beside a certain side edge of the main display area 21 and is in close connection with the main display area 21. Or, the display layer 20 may comprise not only the auxiliary display area 22 at the notch portion formed in the main display area 21 but also the auxiliary display area 22 arranged beside a certain side edge of the main display area 21.

Figure 9:
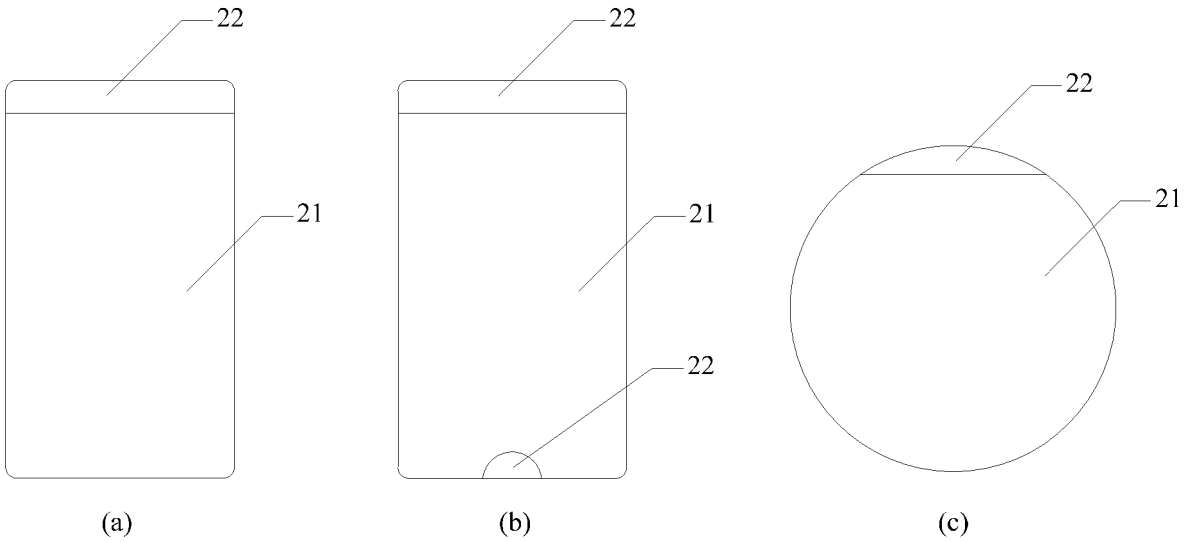
FIG. 9A shows an example schematic view of a first position relationship of a main display area and an auxiliary display area.
FIG. 9B shows an example schematic view of a first position relationship of a main display area and an auxiliary display area.
FIG. 9C shows an example schematic view of a first position relationship of a main display area and an auxiliary display area.

FIG. 9A-9C illustrate several possible position relationships between the main display area 21 and the auxiliary display area 22. In FIG. 9A, the main display area 21 has a rectangular shape and is disposed below the auxiliary display area 22. In FIG. 9B, there are two auxiliary display areas 22 disposed at the top and bottom of the terminal device. In FIG. 9C, the terminal device has a round display screen including an auxiliary display area 22 near the upper edge and the main display area 21 below the auxiliary display area 22.

Optionally, the terminal screen is in a regular shape which comprises at least one of a rectangle, a rounded rectangle, and a circle. Certainly, in some other possible embodiments, the terminal screen may be in an irregular shape, which will not be limited by the present disclosure.

In addition, the substrate 10 may comprise a first substrate area arranged below the main display area 21 and n second substrate areas arranged below the n auxiliary display areas 22 respectively. Wherein a projection area of the main display area 21 on the substrate 10 is the first substrate area, a projection area of any auxiliary display area 22 on the substrate 10 is the second substrate area that corresponds to the auxiliary display area 22.

In a possible implementation, the first substrate area and the n second substrate areas are made of the same material. That is, the substrate 10 is an entire board made of the same material. For example, the substrate 10 may be made of glass or PI.

In another possible implementation, the first substrate area and at least one second substrate area are made of different materials. For example, the first substrate area and a j-th second substrate area in the n second substrate areas are made of different materials, wherein j is a positive integer that is less than or equal to n. Exemplarily, the first substrate area is made of PI, and the j-th second substrate area is made of glass. Glass has better light transmittance than PI. However, glass is a hard material and is inflexible while a flexible screen may be made by PI. By adoption of the above mode, since the first substrate area that corresponds to the main display area 21 is made of PI, most area of the terminal screen is bendable to realize the design of the flexible screen. Further, since the second substrate area that corresponds to the auxiliary display area 22 is made of glass with better light transmittance, such light-sensitive devices as the camera and the sensor, disposed below the auxiliary display area 22, are better in working performance.

Certainly, in some other implementations, the first substrate area may be made of glass with a first attribute, and the j-th second substrate area is made of glass with a second attribute. The first attribute and the second attribute are two different attributes. For example, the glass with the first attribute and the glass with the second attribute have different glass fiber components. Or, the first substrate area may be made of PI with a third attribute, and the j-th second substrate area is made of PI with a fourth attribute, wherein the third attribute and the fourth attribute are two different attributes. For example, PI with the third attribute is yellow PI, and PI with the fourth attribute is color PI. The light transmittance performance of the color PI is superior to that of the yellow PI.

It should be noted that the substrate 10 of the terminal screen is of an integrated structure. That is, the main display area and the auxiliary display area are formed on the same substrate. If the first substrate area and the second substrate area are made of the same material, the substrate 10 is an entire plate made of the same material. If the first substrate area and the second substrate area are made of different materials, the first substrate area and the second substrate area may be spliced without seams by a relevant process to form the substrate 10 of the integrated structure.

In addition, the display layer 20 is usually controlled by a driver IC. In an example, the main display area 21 and the auxiliary display area 22 share the same driver IC. For example, the driver IV may be divided into two portions, one for driving the main display area 21 and the other for driving the auxiliary display area 22. In another example, the main display area 21 and the auxiliary display area 22 use different driver ICs. For example, the terminal screen comprises two driver ICs, one for driving the main display area 21, and the other for driving the auxiliary display area 22. Besides, when the display layer 20 comprises a plurality of auxiliary display areas 22, the plurality of auxiliary display areas 22 may share the same driver IC, and may also use different driver ICs, which will not be limited by the present disclosure.

Besides, the terminal screen may further comprise a touch sensitive layer and a glass cover plate besides the substrate 10 and the display layer 20 described above. The touch sensitive layer is arranged on the display layer 20, and the glass cover plate is arranged on the touch sensitive layer. The touch sensitive layer is configured to achieve a touch sensitive function, for example, to detect such operations as clicking, sliding and pressing of a finger of the user. The glass cover plate is configured to protect the terminal screen so as to prolong its service life.

The terminal screen provided by the embodiment of the present disclosure may be an LCD (Liquid Crystal Display)

screen or an OLED screen. When being the OLED screen, the terminal screen may be a flexible screen or an inflexible screen.

When the terminal screen is the LCD screen, the display layer 20 may comprise a TFT array, a liquid crystal layer and a CF (Color Filter) which are sequentially arranged from bottom to top. The substrate arranged below the display layer 20 may be made of glass and called a lower substrate. Usually, an upper substrate which may also be made of glass is further disposed above the display layer 20. Besides, a lower polaroid may also be disposed below the lower substrate, and an upper polaroid may also be disposed on the upper substrate. Besides, the LCD screen further comprises a backlight module arranged below the lower polaroid.

When the terminal screen is the OLED screen, the display layer 20 may comprise an ITO (Indium Tin Oxide) anode, a hole transport layer, an organic light-emitting layer, an electron transport layer and a metal cathode which are sequentially arranged from bottom to top. The substrate arranged below the display layer 20 may be made of glass, plastic, a metal foil or other materials.

Certainly, the above description about a layered structure of the LCD screen and the OLED screen is merely exemplary and explanatory, and is not intended to limit the technical solutions of the present disclosure.

In an example, taking a rigid AMOLED (Active-matrix Organic Light-Emitting Diode) screen as an example, a production process of the rigid AMOLED may include the following steps: preparing a substrate, for example, a glass substrate with excellent light transmittance (e.g., greater than 90%); forming a display layer that includes a plurality of functional layers on the substrate, for example, forming an insulating layer and a flattening layer on the whole surface of the substrate first, and then, sequentially forming an anode, a pixel definition layer, a hole injection layer, a hole transport layer, an electron excitation layer (including a plurality of layers to form different colors), an electron transport layer, an electron injection layer and a cathode; and finally, performing a package process to form the AMOLED screen. To produce the AMOLED screen that includes a main display area and an auxiliary display area according to the embodiment of the present disclosure, a relevant operation needs to be performed in the position, where the auxiliary display area is located, of a screen body. For example, during production of the cathode in the auxiliary display area, a cathode material with high light transmittance, e.g., a transparent ITO material, is selected. During production, the whole AMOLED screen (including the main display area and the auxiliary display area) may be made from the above-mentioned cathode material with high light transmittance.

Alternatively, only the auxiliary display area is made from the cathode material with high light transmittance, but the main display area is still made from a traditional cathode material with low light transmittance. If the main display area and the auxiliary display area are made from different cathode materials, a cathode of the main display area may be generated first (at this time, the auxiliary display area is shielded). After that, a cathode of the auxiliary display area is generated (at this time, the main display area is shielded). The production process of the cathode includes but not limited to at least one of evaporation, coating, spray printing and sputtering. Certainly, the production process of the rigid AMOLED screen, introduced above, is merely exemplary and explanatory. The forgoing technological processes may be increased, reduced or adjusted in accordance with actual conditions to meet actual production demands. In addition, the above introduction only takes the technological production processes of the rigid AMOLED screen as an example for explanation. On the basis of the content provided by the embodiment of the present disclosure, it is obvious for those skilled in the art to expand the foregoing technological processes by professional knowledge to obtain technological production processes of a flexible AMOLED screen, other OLED screens or an LCD screen. It should be understood that during forming of the main display area and the auxiliary display area, part of the functional layers may be synchronously formed on the integrated substrate without processing the main display area and the auxiliary display area differently.

To sum up, in the technical solution provided by the embodiments of the present disclosure, the display layer of an integrated structure is disposed on the substrate and divided into the main display area and the auxiliary display area by the manufacturing process. The main display area and the auxiliary display area have different manufacturing attributes. Since both the main display area and the auxiliary display area have a display function and no splicing clearances exists therebetween, the display content of the main display area and the auxiliary display area may be an integral whole and free from such defects as incompleteness and clearance. Besides, compared with a special-shaped screen, the terminal screen has the advantage that the screen-to-body ratio is further increased to be closer to or even reach 100%.

In addition, as such functional devices as the camera, the light sensor and the fingerprint recognition sensor may be disposed below the auxiliary display area, the functional devices that occupy the space of the front panel of the terminal are disposed below the screen. Thus, the space of the front panel of the terminal is maximally released, increasing the screen-to-body ratio. Further, by adopting that the light transmittance of the auxiliary display area is greater than that of the main display area, such light-sensitive functional devices as the camera and the light sensor arranged below the auxiliary display area can work normally, maximally guaranteeing the working performance of the functional devices.

An exemplary embodiment of the present disclosure further discloses a terminal, which may be such electronic devices as a mobile phone, a tablet PC, an e-book reader, a multimedia player, a wearable device and a vehicle-mounted terminal. The terminal comprises the terminal screen provided by the embodiment of FIG. 1 or any of the above optional embodiments.

Figure 10:
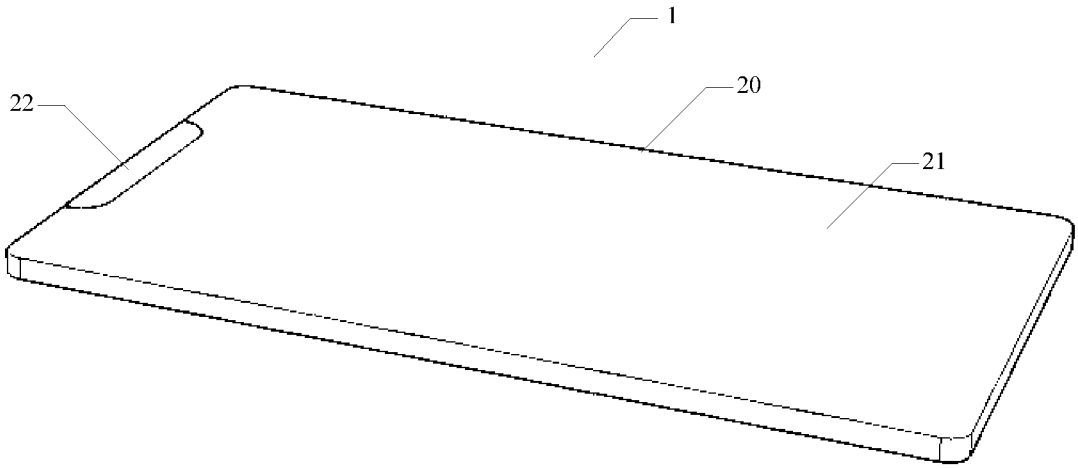
FIG. 10 is a schematic view of a terminal in accordance with an aspect of the disclosure.

In an example, as shown in FIG. 10, the terminal 1 comprises a terminal screen, which comprises a substrate (not shown) and a display layer 20 arranged on the substrate. Optionally, a touch sensitive layer and a glass cover plate may be further disposed on the display layer 20.

As shown in FIG. 10 the display layer 20 comprises a main display area 21 and an auxiliary display area 22. FIG. 10 only takes that the display layer 20 comprises one auxiliary display area 22 arranged in a notch portion formed in an edge at the top of the main display area, and the auxiliary display area 22 and the main display area 21 together form the display layer 20 of which a cross-section is in the shape of a rounded rectangle as an example. Referring to the forgoing embodiments for other design solutions of the auxiliary display area 22 and the main display area 21, which will not be repeated by embodiments.

The light transmittance performance of the auxiliary display area 22 is superior to that of the main display area 21. For example, the light transmittance of the auxiliary display area 22 is greater than that of the main display area 21. Optionally, the light transmittance of the auxiliary display area 22 is greater than 30% to meet normal working demands of the functional devices. In practice, an appropriate material, process or pixel distribution pattern may be selected in accordance with requirements of the functional devices on light transmittance to produce the auxiliary display area 22 that conforms to the forgoing requirement on the light transmittance. Optionally, as technology advances, the light transmittance of the auxiliary display area 22 may reach or approach 100%.

Functional devices (not shown) are disposed below the auxiliary display area 22. The functional devices comprise but not limited to at least one of a camera, an earphone, a light sensor, a distance sensor, a biosensor, an environmental sensor, food safety detection sensor, a health sensor and an optical transmitter. Referring to the text above for the description of each functional device, which will not be repeated herein. In an example, the camera, the earphone, the light sensor and the distance sensor are disposed below the auxiliary display area 22.

Moreover, in consideration of a relatively short distance between the display layer 20 and the substrate 10, for example, a distance of only 0.1 mm between the display layer 20 and the substrate 10, it is impossible that the functional devices are disposed between the display layer 20 and the substrate 10. Optionally, the functional devices are disposed below the substrate 10. That is, the functional devices and the terminal screen are stacked. The functional devices are located below the terminal screen without occupying the space of the terminal screen. Certainly, in some possible examples, the functional devices that are relatively thin in thickness may be disposed between the display layer 20 and the substrate 10, which will not be limited by the present disclosure.

In addition, there is no hole in the terminal screen provided by the embodiment of the present disclosure. That is, no hole exits in the main display area 21 or the auxiliary display area 22. Since such functional devices as the camera and the sensor may be disposed below the terminal screen, no hole needs to be formed in the terminal screen to place these functional devices. Besides, since the manufacturing attribute of the auxiliary display area 22 is different from that of the main display area 21, the functional devices disposed below the terminal screen may work normally so long as the manufacturing attribute of the auxiliary display area 22 is reasonably designed to ensure that the light transmittance of the auxiliary display area 22 meets the normal working demands instead of forming a hole in the terminal screen to improve the light-transmitting performance. Thus, the display content of neither the main display area 21 nor the auxiliary display area 22 may be incomplete due to hole forming. Taking the terminal screen illustrated by FIG. 1 as an example, since the whole display layer 20 formed by combining the main display area 21 with the auxiliary display area 22 has a rectangular section, the display content of the whole display layer 20, formed by combining the display content of the main display area 21 with the display content of the auxiliary display area 22, is a rectangular picture in which neither incompleteness nor clearance exits due to hole forming.

It should be noted that in the terminal screen provided by the present disclosure, the whole auxiliary display area 22 has the ability to display. However, in some specific situations, a certain portion of or the whole auxiliary display area 22 may be controlled not to display. That is, whether the auxiliary display area 22 displays the content and the content is displayed in or not in which portion of the auxiliary display area may be flexibly controlled in accordance with actual demands.

In addition, the terminal may comprise one terminal screen described by the present disclosure, or a plurality of terminal screens described by the present disclosure, or one or a plurality of terminal screens described by the present disclosure and one or a plurality of conventional terminal screens, which will not be limited by the embodiment of the present disclosure.

According to the terminal provided by the embodiment of the present disclosure, such functional devices as the camera, the light sensor and the fingerprint recognition sensor are disposed below the auxiliary display area, so that these functional devices that occupy the space of a front panel of the terminal are disposed below the screen, maximally releasing the space of the front panel of the terminal and increasing the screen-to-body ratio. If the terminal screen has a border, only the border will reduce the screen-to-body ratio to some extent. If the terminal screen does not have a border, the screen-to-body ratio may reach 100%, realizing a full screen in its true sense.

Further, as the light transmittance of the auxiliary display area is designed to be greater than that of the main display area, such light-sensitive functional devices as the camera and the light sensor arranged below the auxiliary display area can work normally, maximally guaranteeing the working performance of the functional devices.

An exemplary embodiment of the present disclosure further provides a control method of a terminal screen, which is used for controlling the terminal screen provided by the embodiment of FIG. 1 or any of the above optional embodiments. The method may be executed by a driver IC of the terminal screen, or a processor in a terminal, or executed through interaction and cooperation between a plurality of components with the processing capacity in the terminal. The method comprises the following steps: sending a first synchronizing signal to the main display area and a second synchronizing signal to the auxiliary display area.

The first synchronizing signal and the second synchronizing signal are configured to control the main display area and the auxiliary display area to simultaneously display the same content. The same content may also be called the same display or the same frame. Since the main display area and the auxiliary display area are respectively controlled by two different driver ICs or different portions of the same driver IC, when the main display area and the auxiliary display area need to display different portions of the same content, frame synchronization between the main display area and the auxiliary display area needs to be ensured, so as to prevent the main display area and the auxiliary display area from displaying different frames and adversely affecting a display effect thereof.

By adoption of the terminal screen provided by the embodiment of the present disclosure, the display contents of the main display area and the auxiliary display area are combined to form a complete display content. The complete display content is equivalent to a complete display content that may be displayed by another terminal screen, which has the same size and shape as this terminal screen but is not divided into the main display area and the auxiliary display area. However, owing to high light transmittance of the auxiliary display area, some functional devices may be disposed below the auxiliary display area, and their normal working performance is guaranteed. Thus, the functional devices that originally need to be disposed on the front panel of the terminal may be disposed below the terminal screen without sacrificing the display quality of the terminal screen. Accordingly, the screen-to-body ratio of the terminal screen may be closer to or even reach 100%.

Optionally, the method further comprises the following steps: sending a first color parameter that corresponds to a first color to the main display area in accordance with the first color required to be displayed by a first pixel in the main display area; and sending a second color parameter that corresponds to a second color to the auxiliary display area in accordance with the second color required to be displayed by a second pixel in the auxiliary display area.

The first pixel may be any pixel in the main display area. The second pixel may be any pixel in the auxiliary display area. Since the main display area and the auxiliary display area have different manufacturing attributes, when the main display area and the auxiliary display area present the same color effect, the employed color parameters may also be different. The color parameter may comprise the value of each color component of R, G and B. Through the above mode, the first color parameter and second color parameter are respectively provided for the main display area and the auxiliary display area. When the first color and the second color are the same, a color effect presented by the first pixel in accordance with the first color parameter is the same as a color effect presented by the second pixel in accordance with the second color parameter, thereby ensuring color match between the main display area and the auxiliary display area.

In a possible implementation, the first color parameter that corresponds to the first color is acquired by the following steps: searching for a first corresponding relationship which comprises a corresponding relationship between a color and a color parameter in the main display area; and acquiring the first color parameter that corresponds to the first color from the first corresponding relationship. Likewise, the second color parameter that corresponds to the second color is acquired by the following steps: searching for a second corresponding relationship which comprises a corresponding relationship between a color and a color parameter in the auxiliary display area; and acquiring the second color parameter that corresponds to the second color from the second corresponding relationship.

In another possible implementation, the first color parameter that corresponds to the first color is acquired by obtaining the first color parameter that corresponds to the first color through calculation in accordance with the first color and a screen parameter of the main display area. Likewise, the second color parameter that corresponds to the second color is acquired by obtaining the second color parameter that corresponds to the second color through calculation in accordance with the second color and a screen parameter of the auxiliary display area.

Optionally, in consideration that resolution of the main display area may be higher than that of the auxiliary display area, to ensure a smooth transition from a display effect of the main display area to a display effect of the auxiliary display area when the two display areas display different portions of the same user interface, the method further comprises the following steps: determining a display parameter of a portion joined with the auxiliary display area in the main display area in accordance with the content required to be displayed by the main display area and the auxiliary display area; and sending the display parameter of the joined portion to the main display area. The main display area is configured to control the joined portion to display in accordance with the display parameter of the joined portion.

The joined portion may comprise a plurality of pixels, which are closest to the auxiliary display area, in the main display area. The display parameter of the joined portion is used for ensuring the smooth transition from the display effect of the main display area to the display effect of the auxiliary display area. Thus, the display effects in the two display areas may not be obviously different due to inconsistent resolutions. The screen reading experience of the user is improved.

Moreover, when the terminal is in different working statuses, the auxiliary display area may have different display contents. Optionally, when the terminal in a target working status, a target display content that needs to be displayed by the auxiliary display area and corresponds to the target working status is determined, and the auxiliary display area is controlled to display the target display content. In the embodiment of the present disclosure, a division mode of the working status of the terminal is not limited. For example, the working status of the terminal may include a shooting mode, a talk mode, a reading mode, etc. The target display content may include one or a plurality of color blocks.

In an example, taking that the target working status is the shooting mode as an example, in the shooting mode, the camera located below the auxiliary display area needs to work. The terminal may control the auxiliary display area to display a pure color (e.g., black) block to improve the light transmittance of the auxiliary display area. Thus, interference to an image is reduced as much as possible, improving the image quality.

The device embodiments of the present disclosure may be used to implement the method embodiments of the present disclosure. For details which are not disclosed in the device embodiments of the present disclosure may be made reference to the method embodiments.

Figure 11:
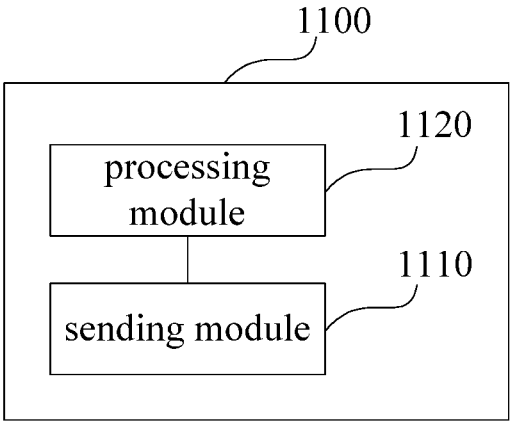
FIG. 11 is a block diagram of a control device of a terminal screen in accordance with an aspect of the disclosure.

FIG. 11 is a block diagram of a control device of a terminal screen in accordance with an aspect of the disclosure. The device has the function of implementing the above method examples. The device may be implemented through hardware or relevant software executed by hardware. The device may be the terminal described above, and may also be set in the terminal described above. The device is configured to control the terminal screen provided in the embodiment shown in FIG. 1 or any of the above optional embodiments. As shown in FIG. 11, the device 1100 may include: a sending module 1110.

The sending module 1110 is configured to send a first synchronizing signal to the main display area and a second synchronizing signal to the auxiliary display area, the first synchronizing signal and the second synchronizing signal being configured to control the main display area and the auxiliary display area to simultaneously display the same content.

Optionally, the sending module 1110 is further configured to:

send a first color parameter that corresponds to a first color to the main display area in accordance with the first color required to be displayed by a first pixel in the main display area; and send a second color parameter that corresponds to a second color to the auxiliary display area in accordance with the second color required to be displayed by a second pixel in the auxiliary display area, wherein when the first color and the second color are the same, a color effect presented by the first pixel in accordance with the first color parameter is the same as a color effect presented by the second pixel in accordance with the second color parameter.

Optionally, as shown in FIG. 11, the device 1100 further includes: a processing module 1120.

The processing module 1120 is configured to determine a display parameter of a portion joined with the auxiliary display area in the main display area in accordance with the content required to be displayed by the main display area and the auxiliary display area, the display parameter of the joined portion being configured to ensure a smooth transition from a display effect of the main display area to a display effect of the auxiliary display area.

The sending module 1110 is further configured to send the display parameter of the joined portion to the main display area, the main display area being configured to control the joined portion to display in accordance with the display parameter of the joined portion.

It should be noted that the device provided by the above embodiment is exemplified only by the above division of each of the functional modules when the implementing the functions. In practice, the above-described functions may be assigned and completed by different functional modules in accordance with requirements, that is, the internal structure of the device can be divided into different functional modules to complete all or part of the functions described above.

With respect to the device of the above embodiment, the specific method of operation performed by each module has been described in details in the embodiment of the method, and the description thereof may not be described in details herein.

An exemplary embodiment of the present disclosure further provides a terminal, capable of implementing the control method of a terminal screen provided by the present disclosure. The terminal includes the terminal screen provided in the embodiment shown in FIG. 1 or any optional embodiment, and the terminal further includes: a processor; and a memory for storing instructions executable by the processor. The processor is configured to: send a first synchronizing signal to the main display area and a second synchronizing signal to the auxiliary display area, the first synchronizing signal and the second synchronizing signal being configured to control the main display area and the auxiliary display area to simultaneously display the same content.

Optionally, the processor is further configured to: send a first color parameter that corresponds to a first color to the main display area in accordance with the first color required to be displayed by a first pixel in the main display area; and send a second color parameter that corresponds to a second color to the auxiliary display area in accordance with the second color required to be displayed by a second pixel in the auxiliary display area. When the first color and the second color are the same, a color effect presented by the first pixel in accordance with the first color parameter is the same as a color effect presented by the second pixel in accordance with the second color parameter.

Optionally, the processor is further configured to: determine a display parameter of a portion joined with the auxiliary display area in the main display area in accordance with the content required to be displayed by the main display area and the auxiliary display area, the display parameter of the joined portion being configured to ensure a smooth transition from a display effect of the main display area to a display effect of the auxiliary display area; and send the display parameter of the joined portion to the main display area, the main display area being configured to control the joined portion to display in accordance with the display parameter of the joined portion.

Figure 12:
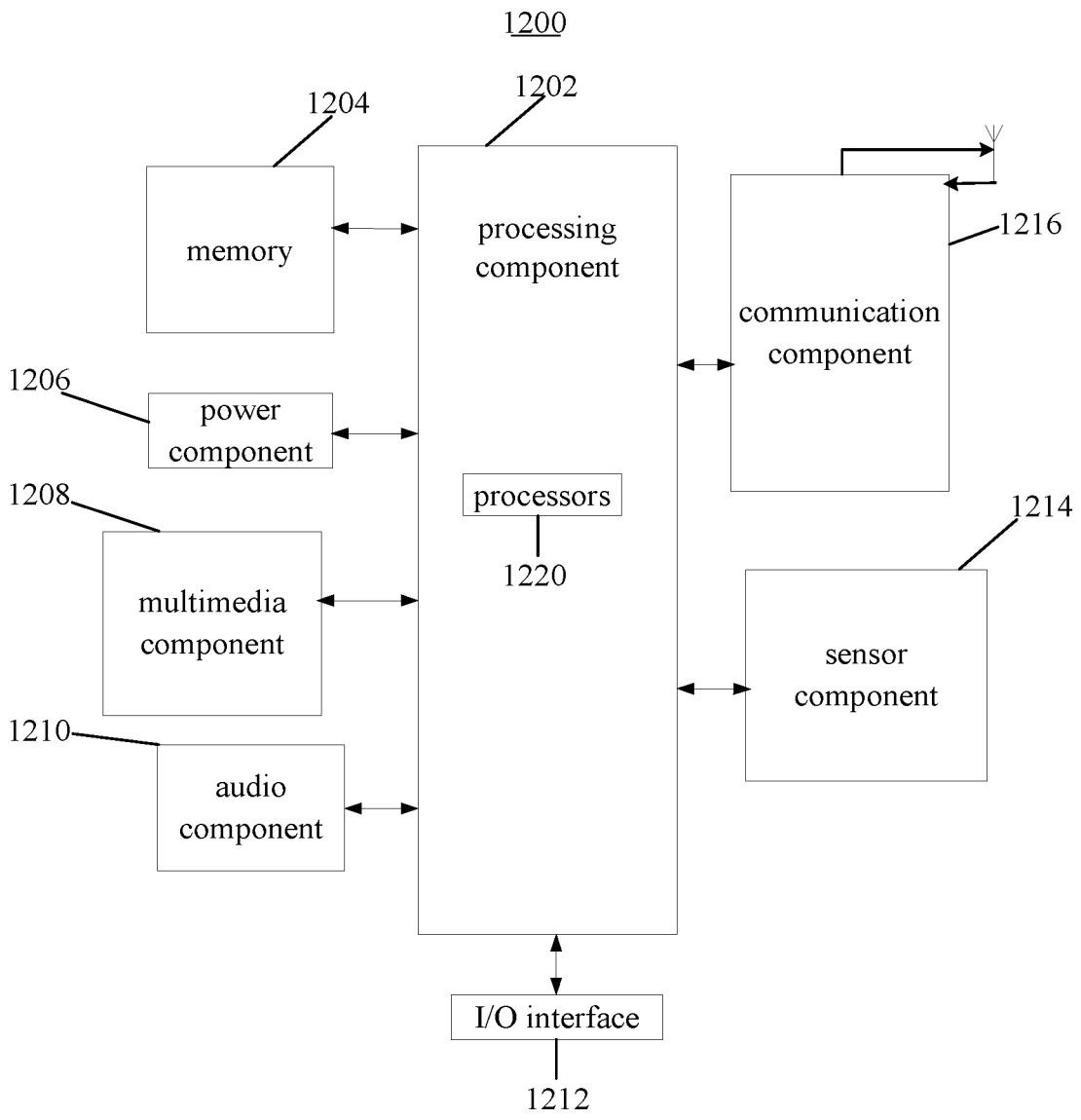
FIG. 12 is a block diagram of a structure of a terminal in accordance with an exemplary embodiment.

FIG. 12 is a block diagram of a structure of a terminal 1200 shown in accordance with an aspect of the disclosure. For example, the terminal 1200 may be such electronic devices as a mobile phone, a tablet PC, an e-book reader, a multimedia player, a wearable device, a vehicle-mounted terminal.

Referring to FIG. 12, the terminal 1200 may include one or more of the following components: a processing component 1202, a memory 1204, a power component 1206, a multimedia component 1208, an audio component 1210, an input/output (I/O) interface 1212, a sensor component 1214, and a communication component 1216.

The processing component 1202 typically controls the overall operations of the terminal 1200, such as the operations associated with display, telephone calls, data communications, camera operations, and recording operations. The processing component 1202 may include one or more processors 1220 to execute instructions to perform all or part of the steps in the methods described above. Moreover, the processing component 1202 may include one or more modules which facilitate the interaction between the processing component 1202 and other components. For instance, the processing component 1202 may include a multimedia module to facilitate the interaction between the multimedia component 1208 and the processing component 1202.

The memory 1204 is configured to store various types of data to support the operation of the terminal 1200. Examples of such data include instructions for any applications or methods operated on the terminal 1200, contact data, phonebook data, messages, pictures, videos, etc. The memory 1204 may be implemented by using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 1206 provides power to various components of the terminal 1200. The power component 1206 may include a power management system, one or more power sources, and any other components associated with the generation, management, and distribution of power in the terminal 1200.

The multimedia component 1208 includes a terminal screen providing an output interface between the terminal 1200 and the user. The terminal screen may be the terminal screen provided in the embodiment shown in FIG. 1 or any of the above optional embodiments. In some embodiments, the multimedia component 1208 includes a front camera and/or a rear camera. The front camera and/or the rear camera may receive external multimedia data while the terminal 1200 is in an operation mode, such as a photographing mode or a video mode. Each of the front camera and the rear camera may be a fixed optical lens system or have focus and optical zoom capability.

The audio component 1210 is configured to output and/or input audio signals. For example, the audio component 1210 includes a microphone (MIC) configured to receive external audio signals when the terminal 1200 is in an operation mode, such as a call mode, a recording mode, and a voice recognition mode. The received audio signals may be further stored in the memory 1204 or transmitted via the communication component 1216. In some embodiments, the audio component 1210 further includes a speaker for outputting audio signals.

The I/O interface 1212 provides an interface between the processing component 1202 and peripheral interface modules, the peripheral interface modules may be a keyboard, a click wheel, buttons, and the like. The buttons may include, but are not limited to, a home button, a volume button, a start button, and a lock button.

The sensor component 1214 includes one or more sensors to provide status assessments of various aspects of the terminal 1200. For instance, the sensor component 1214 may detect an on/off status of the terminal 1200, relative positioning of components, e.g., the displayer and the mini keyboard of the terminal 1200, and the sensor component 1214 may also detect a position change of the terminal 1200 or a component of the terminal 1200, presence or absence of user contact with the terminal 1200, orientation or acceleration/deceleration of the terminal 1200, and temperature change of the terminal 1200. The sensor component 1214 may include a proximity sensor configured to detect the presence of nearby objects without any physical contact. The sensor component 1214 may also include a light sensor, such as a CMOS or CCD image sensor, used for imaging applications. In some embodiments, the sensor component 1214 may also include an accelerometer sensor, a gyroscope sensor, a magnetic sensor, a pressure sensor, or a temperature sensor.

The communication component 1216 is configured to facilitate wired or wireless communication between the terminal 1200 and other devices. The terminal 1200 can access a wireless network based on a communication standard, such as Wi-Fi, 2G or 3G 4G 5G or a combination thereof. In an exemplary embodiment, the communication component 1216 receives broadcast signals or broadcast associated information from an external broadcast management system via a broadcast channel. In an exemplary embodiment, the communication component 1216 further includes a near field communication (NFC) module to facilitate short-range communications.

In exemplary embodiments, the terminal 1200 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer-readable storage medium including instructions, such as—the memory 1204 including instructions which is executable by the processor 1220 in the terminal 1200, for performing the above-described methods. For example, the non-transitory computer-readable storage medium may be a ROM, a random access memory (RAM), a CD-ROM, a magnetic tape, a floppy disc, an optical data storage device, and the like.

There is provided a non-transitory computer-readable storage medium, having stored therein computer programs that, when executed by the processor of the terminal 1200, may implement the control method of the terminal screen described above.

It should be understood that the term "plurality" herein refers to two or more. "And/or" herein describes the correspondence of the corresponding objects, indicating three kinds of relationship. For example, A and/or B, can be expressed as: A exists alone, A and B exist concurrently, B exists alone. The character "/" generally indicates that the context object is an "OR" relationship.

Other embodiments of the present disclosure can be available to those skilled in the art upon consideration of the specification and practice of the invention disclosed herein. The present application is intended to cover any variations, uses, or adaptations of the present disclosure following general principles of the present disclosure and including the common general knowledge or conventional technical means in the art without departing from the present disclosure. The specification and examples can be shown as illustrative only, and the true scope and spirit of the disclosure are indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A terminal screen, comprising a substrate and a display layer on the substrate, wherein the display layer comprises a main display area and n auxiliary display areas, and n is a positive integer;

the main display area and an i-th auxiliary display area in the n auxiliary display areas have different attributes, and i is a positive integer that is less than or equal to n;

the substrate is of an integrated structure and comprises a first substrate area below the main display area and n second substrate areas below the n auxiliary display areas respectively, wherein the first substrate area is a first projection area of the main display area on the substrate, and the n second substrate areas are second projection areas of the n auxiliary display areas on the substrate;

the first substrate area and a j-th second substrate area in the n second substrate areas are made of different materials, and j is a positive integer that is less than or equal to n; and the first substrate area is made of polyimide PI, and the j-th second substrate area is made of glass.

2. The terminal screen according to claim 1, wherein the attribute comprises resolution, and the resolution of the main display area is higher than that of the i-th auxiliary display area.

3. The terminal screen according to claim 1, wherein the attribute comprises light transmittance performance, and the light transmittance performance of the main display area is poorer than that of the i-th auxiliary display area.

4. The terminal screen according to claim 1, wherein the attribute comprises pixel features.

5. The terminal screen according to claim 4, wherein the main display area and the i-th auxiliary display area have the same pixel distribution pattern, and at least one dummy pixel exists in the i-th auxiliary display area.

6. The terminal screen according to claim 4, wherein the main display area and the i-th auxiliary display area have different pixel distribution patterns.

7. The terminal screen according to claim 1, wherein the attribute comprises manufacturing processes.

8. The terminal screen according to claim 1, wherein the n auxiliary display areas comprise at least one of the following areas:

a first auxiliary display area in a notch portion formed in an edge at the top of the main display area;

a second auxiliary display area in a notch portion formed in an edge on the left side of the main display area;

a third auxiliary display area in a notch portion formed in an edge on the right side of e main display area;

a fourth auxiliary display area in a notch portion formed in an edge at the bottom of the main display area; and a fifth auxiliary display area in a notch portion formed in the middle of the main display area.

9. The terminal screen according to claim 1, wherein:

the main display area and the auxiliary display area share the same driver IC.

10. The terminal screen according to claim 1, wherein the i-th auxiliary display area has a monochrome display function.

11. The terminal screen according to claim 1, wherein the i-th auxiliary display area has a color display function.

12. A terminal, comprising a terminal screen, wherein the terminal screen comprises a substrate and a display layer on the substrate;

the display layer comprises a main display area and n auxiliary display areas, and n is a positive integer, the main display area and an i-th auxiliary display area in the n auxiliary display areas have different attributes, and i is a positive integer that is less than or equal to n, wherein the substrate is of an integrated structure and comprises a first substrate area below the main display area and n second substrate areas below the n auxiliary display areas respectively, and wherein the first substrate area is a first projection area of the main display area on the substrate, and the n second substrate areas are second projection areas of the n auxiliary display areas on the substrate; and the first substrate area and a j-th second substrate area in the n second substrate areas are made of different materials, and j is a positive integer that is less than or equal to n, the first substrate area is made of polyimide PI, and the j-th second substrate area is made of glass, light transmittance performance of the n auxiliary display areas is superior to that of the main display area; and a functional device is disposed below the n auxiliary display areas.

13. The terminal according to claim 12, wherein the functional device comprises at least one of following hardware units:

a camera, an earphone, a light sensor, a distance sensor, a biosensor, an environmental sensor, a food safety detection sensor, a health sensor, and an optical transmitter.

14. The terminal according to claim 12, wherein the n auxiliary display areas have light transmittance greater than 30%.

15. A control method of a terminal screen, configured to control a terminal screen comprising a substrate and a display layer on the substrate, wherein the display layer comprises a main display area and n auxiliary display areas, and n is a positive integer, the main display area and an i-th auxiliary display area in the n auxiliary display areas have different attributes, and i is a positive integer that is less than or equal to n, wherein the substrate is of an integrated structure and comprises a first substrate area below the main display area and n second substrate areas below the n auxiliary display areas respectively, and wherein the first substrate area is a first projection area of the main display area on the substrate, and the n second substrate areas are second projection areas of the n auxiliary display areas on the substrate; and the first substrate area and a j-th second substrate area in the n second substrate areas are made of different materials, and j is a positive integer that is less than or equal to n, the first substrate area is made of polyimide PI, and the j-th second substrate area is made of glass, the method comprising:

sending a first synchronizing signal to the main display area and a second synchronizing signal to the n auxiliary display areas, the first synchronizing signal and the second synchronizing signal being configured to control the main display area and the n auxiliary display areas to simultaneously display the same content.

16. The control method according to claim 15, further comprising:

sending a first color parameter that corresponds to a first color to the main display area in accordance with the first color required to be displayed by a first pixel in the main display area; and sending a second color parameter that corresponds to a second color to the n auxiliary display areas in accordance with the second color required to be displayed by a second pixel in the n auxiliary display areas, wherein when the first color and the second color are the same, a color effect presented by the first pixel in accordance with the first color parameter is the same as a color effect presented by the second pixel in accordance with the second color parameter.

17. The control method according to claim 15, further comprising:

determining a display parameter of a portion joined with the n auxiliary display areas in the main display area in accordance with the content required to be displayed by the main display area and the n auxiliary display areas, the display parameter of the joined portion being configured to ensure a smooth transition from a display effect of the main display area to a display effect of the n auxiliary display areas; and sending the display parameter of the joined portion to the main display area, the main display area being configured to control the joined portion to display in accordance with the display parameter of the joined portion.

* * * * *